US005349425A

United States Patent [19]

Kamijo et al.

[11] Patent Number: 5,349,425

[45] Date of Patent: Sep. 20, 1994

[54] COMBINED CLEANER AND TONER MAGAZINE FOR AN IMAGE FORMING APPARATUS

[75] Inventors: Masahiko Kamijo, Kawasaki; Hiroshi Saitoh, Ayase; Yozo Matsuura, Tokyo; Shiro Kondo, Atsugi, all of Japan

[73] Assignee: Ricoh Company, Ltd., Tokyo, Japan

[21] Appl. No.: 10,876

[22] Filed: Jan. 29, 1993

[30] Foreign Application Priority Data

Jan. 31, 1992 [JP] Japan ..... 4-16405

[51] Int. Cl.[5] ..... G03G 21/00

[52] U.S. Cl. ..... 355/298; 355/296; 355/260; 355/270

[58] Field of Search ..... 355/296, 297, 298, 299, 355/260, 269, 270

[56] References Cited

U.S. PATENT DOCUMENTS

| | | | |
|---|---|---|---|
| 4,697,914 | 10/1987 | Hauser | 355/296 X |
| 4,816,877 | 3/1989 | Keen | 355/260 X |
| 5,126,799 | 6/1992 | Matsuura et al. | 355/298 |
| 5,255,061 | 10/1993 | Matsuura et al. | 355/298 |
| 5,268,720 | 12/1993 | Saitoh et al. | 355/260 X |
| 5,298,952 | 3/1994 | Kamio et al. | 355/270 |

FOREIGN PATENT DOCUMENTS

| | | | |
|---|---|---|---|
| 0202473 | 11/1983 | Japan | 355/298 |
| 0040677 | 3/1984 | Japan | 355/298 |
| 0052676 | 3/1986 | Japan . | |
| 0204670 | 9/1986 | Japan | 355/298 |
| 0314279 | 12/1989 | Japan | 355/298 |
| 0158886 | 7/1991 | Japan | 355/298 |
| 0116583 | 4/1992 | Japan | 355/298 |

*Primary Examiner*—Matthew S. Smith

*Attorney, Agent, or Firm*—Oblon, Spivak, McClelland, Maier & Neustadt

[57] ABSTRACT

A combined cleaner and toner magazine (CTM) applicable to an image forming apparatus and implemented as a single unit made up of a device for supplying a toner to a developing unit and a cleaning device for removing and storing part of the toner which remains on a photoconductive element after image transfer. The CTM has an electromagnetic shutter or a permanent magnet for preventing the toner left on the photoconductive element without being collected by the cleaning device from being scattered around in the apparatus. When a toner reservoir included in the toner supply device is emptied and, at the same time, a waste toner tank in the cleaning device is filled up, a supplementary toner is filled in the toner reservoir via a predetermined opening and the waste toner is discharged from the waste toner tank via another predetermined opening.

7 Claims, 8 Drawing Sheets

COMBINED CLEANER AND TONER MAGAZINE FOR AN IMAGE FORMING APPARATUS

BACKGROUND OF THE INVENTION

The present invention relates to an electrophotographic copier, facsimile transceiver, laser printer or similar image forming apparatus and, more particularly, to a combined cleaner and toner magazine (CTM) made up of a toner supply device for supplying a dry developer, or toner, to a developing unit for developing an electrostatic latent image formed on an image carrier, and a cleaning device for removing and storing the toner which will be left on the photoconductive element after the development.

It is a common practice to replace such a CTM with new one when a waste toner tank included in the cleaning device is filled up with the removed or waste toner and a toner reservoir included in the toner supply device is emptied substantially at the same time. The CTM can be easily replaced by the user and, therefore, facilitates maintenance of the image forming apparatus of the kind mentioned above. For this reason, the CTM is extensively used with modern image forming apparatuses. In the conventional CTM, the cleaning device or section has a cleaning blade held in contact with the photoconductive element for removing the toner remaining thereon, and a raking brush for collecting the removed toner in the waste toner tank. However, the raking brush cannot fully collect the toner in the waste toner tank alone, i.e., causes some toner to remain on the photoconductive element. Hence, when the used CTM is removed from the image forming apparatus, it is likely that the toner left on the photoconductive element is scattered around in the apparatus to effect image formation and image quality. To eliminate this problem, a magnet shutter may be associated with the waste toner tank for catching the remaining toner in the event of replacement of the CTM, as proposed in the past. However, when the magnet shutter is simply implemented as a rubber magnet sheet, it is not satisfactorily resistive to the toner. Moreover, the rubber magnet sheet would catch not only the toner of interest but also a toner floating in the apparatus, failing to fully exhibit the expected function thereof.

The CTM is easy to replace and maintain, as stated earlier. However, discarding all of the used CTMs is not desirable not only from the resources standpoint but also from the environmental pollution standpoint. In addition, the frequent replacement of the CTM, of course, prevents the image forming apparatus from being operated cost effectively.

SUMMARY OF THE INVENTION

It is, therefore, an object of the present invention to provide a CTM applicable to an image forming apparatus and having a waste toner tank provided with a magnet shutter which prevents a remaining toner from being scattered around in the event of replacement and is highly durable.

It is another object of the present invention to provide a CTM which can be repetitively used to promote cost-effective operation of an image forming apparatus while contributing a great deal to the protection of the environment.

A CTM for an image forming apparatus of the present invention comprises a toner supplying device for supplying a toner to a developing unit, a cleaning device constructed integrally with the toner supplying device for removing and storing the toner remaining on a photoconductive element after image transfer, and a preventing device for preventing part of the toner left on the photoconductive element without being stored in the cleaning device from being scattered around in the image forming apparatus.

BRIEF DESCRIPTION OF THE DRAWINGS

The above and other objects, features and advantages of the present invention will become more apparent from the following detailed description taken with the accompanying drawings in which:

FIG. 11 is a perspective view of a cap for closing an opening formed through a waste toner tank of the CTM shown in FIG. 9.

DESCRIPTION OF THE PREFERRED EMBODIMENTS

To better understand the present invention, a reference will be made to a conventional CTM of the type described in, for example, Japanese Patent Application No. 155497/1990 and an image forming apparatus implemented with such a CTM.

Figure 1:
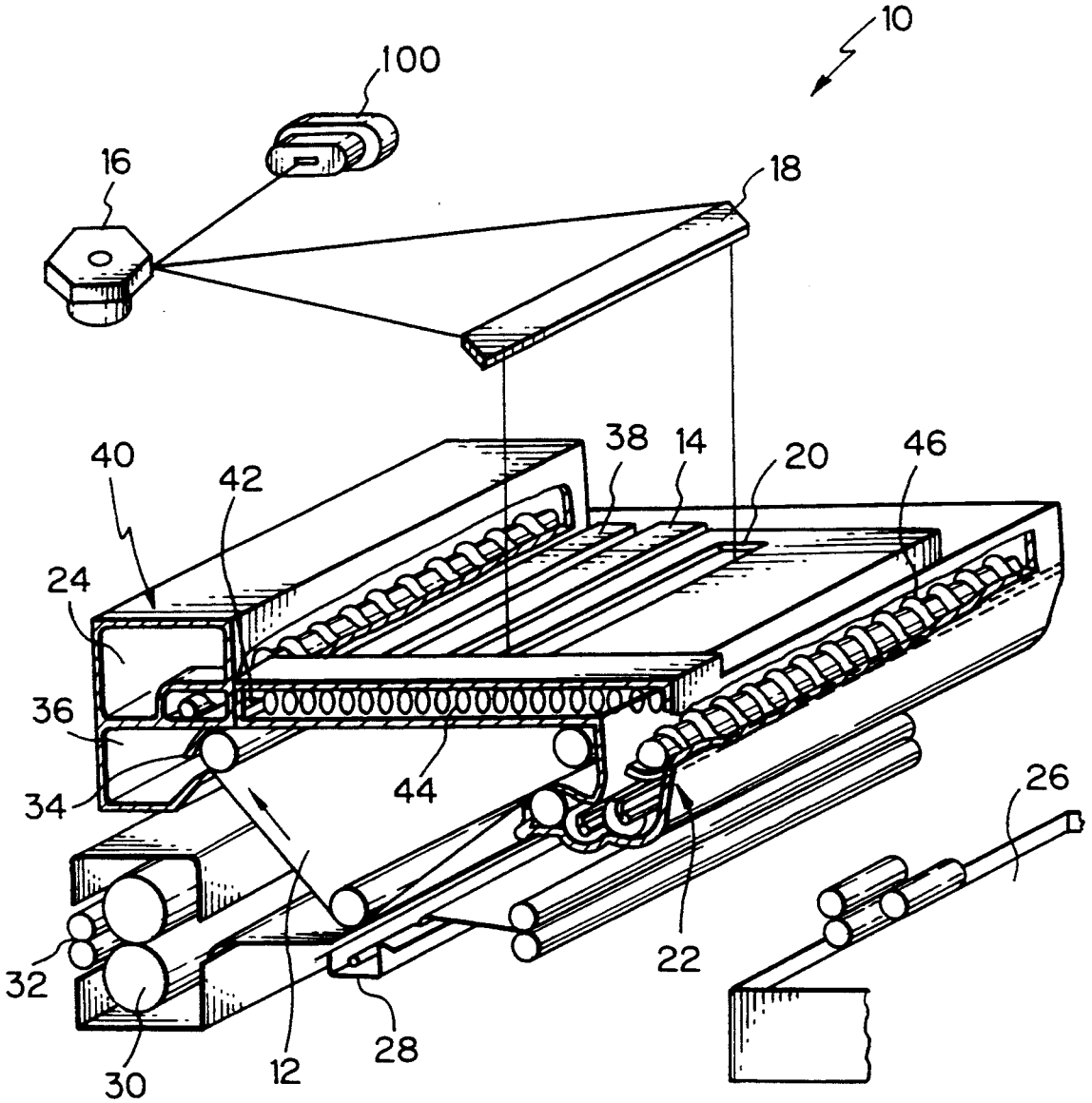
Fig. 1 PRIOR ART
FIG. 1 is a perspective view of an image forming apparatus implemented with a conventional CTM.

FIG. 1 shows an electrophotographic copier which is a specific form of the image forming apparatus. As shown, the copier, generally 10, has a photoconductive element in the form of an endless belt 12 which is movable in a direction indicated by an arrow in the figure. A precharger 14 uniformly charges the surface of the belt 12 being moved. A laser 100 emits a laser beam in response to an image signal. The laser beam is routed through a polygonal mirror 16 and a mirror 18 to an optical writing section 20 so as to scan the charged surface of the belt 12. As a result, a latent image is electrostatically formed on the belt 12. A developing unit 22 develops the latent image by a toner fed thereto from a toner reservoir 24, thereby producing a corresponding toner image. Recording sheets are fed one by one from a sheet cassette 26 to the belt 12. A transfer charger 28 transfers the toner image from the belt 12 to the sheet. A fixing unit 30 fixes the toner image transferred to the sheet by heat. Finally, the sheet with the fixed toner image is driven out of the copier 10 to a tray, not shown, by a discharge roller 32. A cleaning blade 34 removes the toner remaining on the belt 12 after the image transfer. The removed toner is collected in a waste toner tank 36 as a waste toner. A discharge lamp 38 dissipates the charge also remaining on the belt 12 after the image transfer by illuminating it. This prepares the belt 12 for another copying cycle. The toner reservoir 24 and waste toner tank 36 constitute a single CTM 40 in combination which is bodily replaceable. The toner in the toner reservoir 24 is transported from an outlet 42 by a duct or similar conveying mechanism 44 and then enters the developing unit 22 via an inlet. A supply mechanism 46 is disposed in the developing unit 22 to supply the toner in the main scanning direction of the unit 22 in a uniform distribution. Alternatively, the toner reservoir 24 and developing unit 22 may be positioned one above the other, in which case the toner will be let fall from the outlet 42 to the unit 22 via a duct by gravity.

Figure 2A:
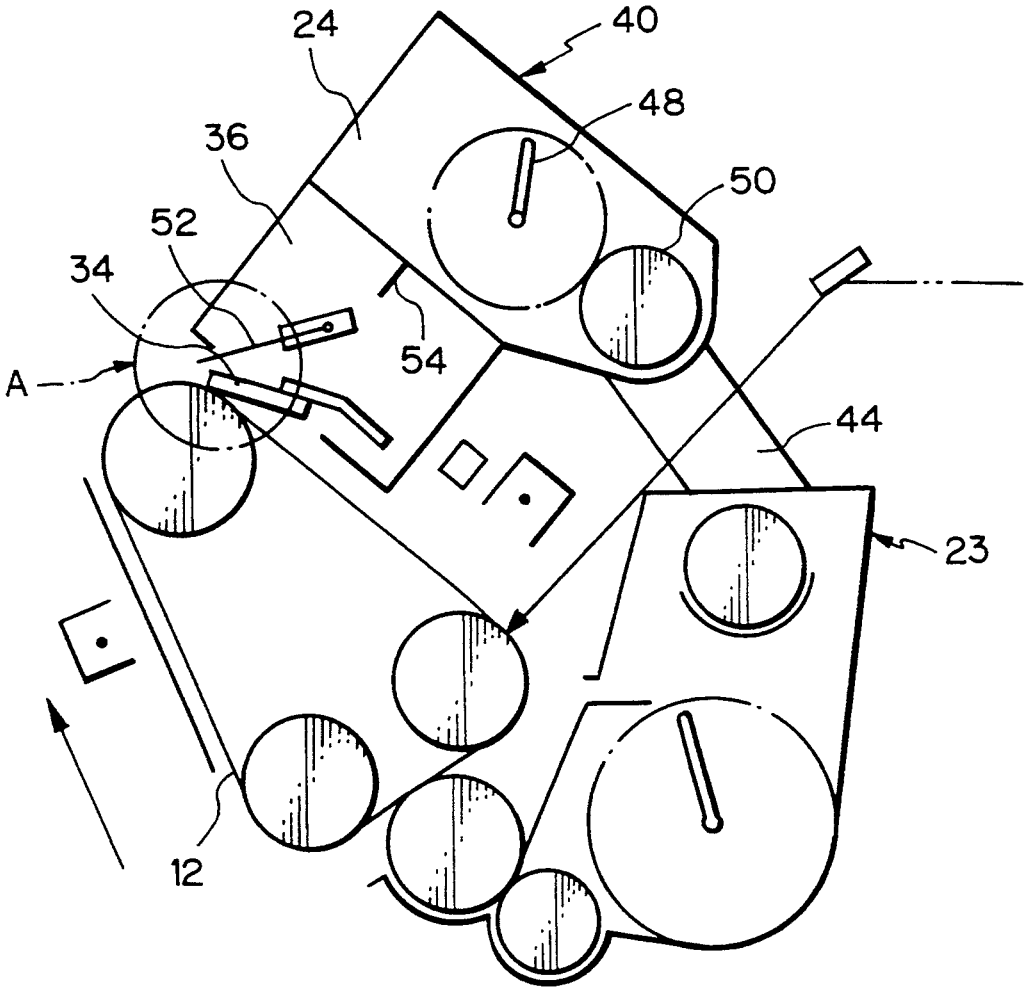
Fig. 2A (PRIOR ART)
FIG. 2A is a section showing the CTM of FIG. 1 more specifically.
Figure 2B:
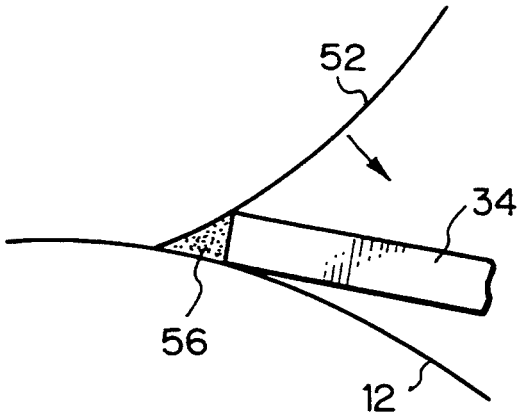
Fig. 2B (PRIOR ART)
FIG. 2B is a view showing a drawback particular to the conventional CTM.

A more specific construction and function of the CTM 40 will be described with reference to FIGS. 2A and 2B. As shown in FIG. 2A, the toner reservoir 24 of the CTM 40 accommodates an agitator 48 for agitating the toner, and a toner supply member 50 for feeding the toner to the duct 44. The waste toner tank 36 accommodates the cleaning blade 34, a raking brush 52 for collecting the toner scraped off by the blade 34, and a flicker 54 for beating the brush 52 to remove the toner therefrom. The problem with the conventional CTM 40 is that the brush 52 cannot sufficiently collect the toner. Specifically, as shown in FIG. 2B, some toner 56 remains on the belt 12 at the edge of the blade 34. Assume that the waste toner tank 36 of the CTM 40 is filled up with the waste toner and the toner reservoir 24 is emptied substantially at the same time. When such a used CTM 40 is removed to be replaced with new one, it is likely that the toner 56 remaining on the belt 12 is scattered around inside the copier, adversely effecting the copying operation and lowering image quality. A magnet shutter may be associated with the waste toner tank 36 to catch the toner 56 in the event of replacement of the used CTM 40. The magnet shutter, however, cannot achieve a satisfactory effect, as discussed earlier.

Figure 3A:
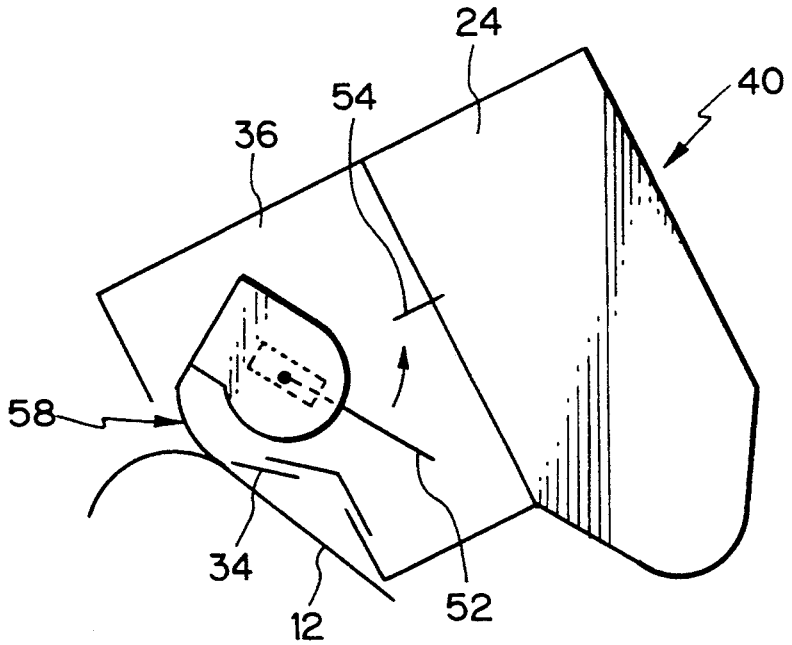
FIGS. 3A and 3B are sections showing a CTM embodying the present invention.
Figure 3B:
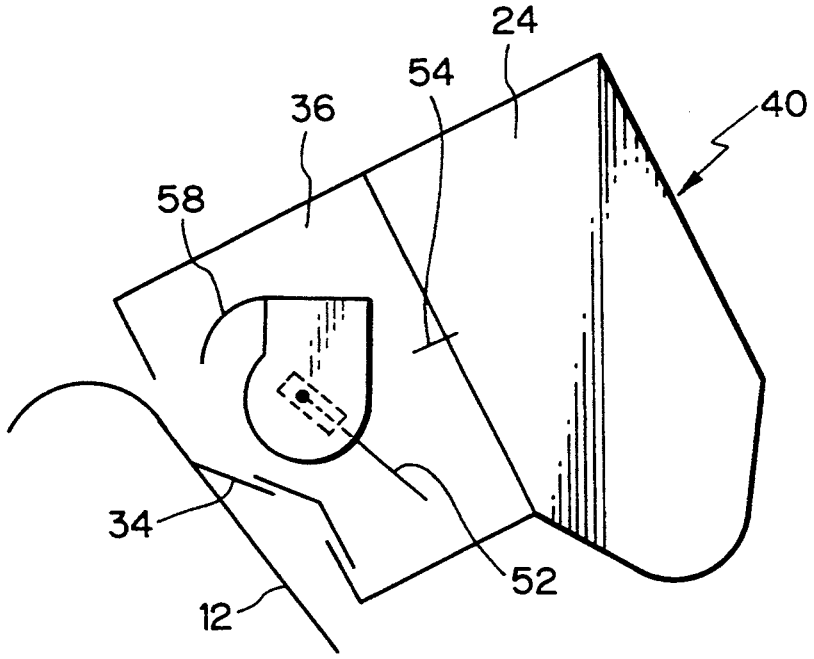
Figure 4:
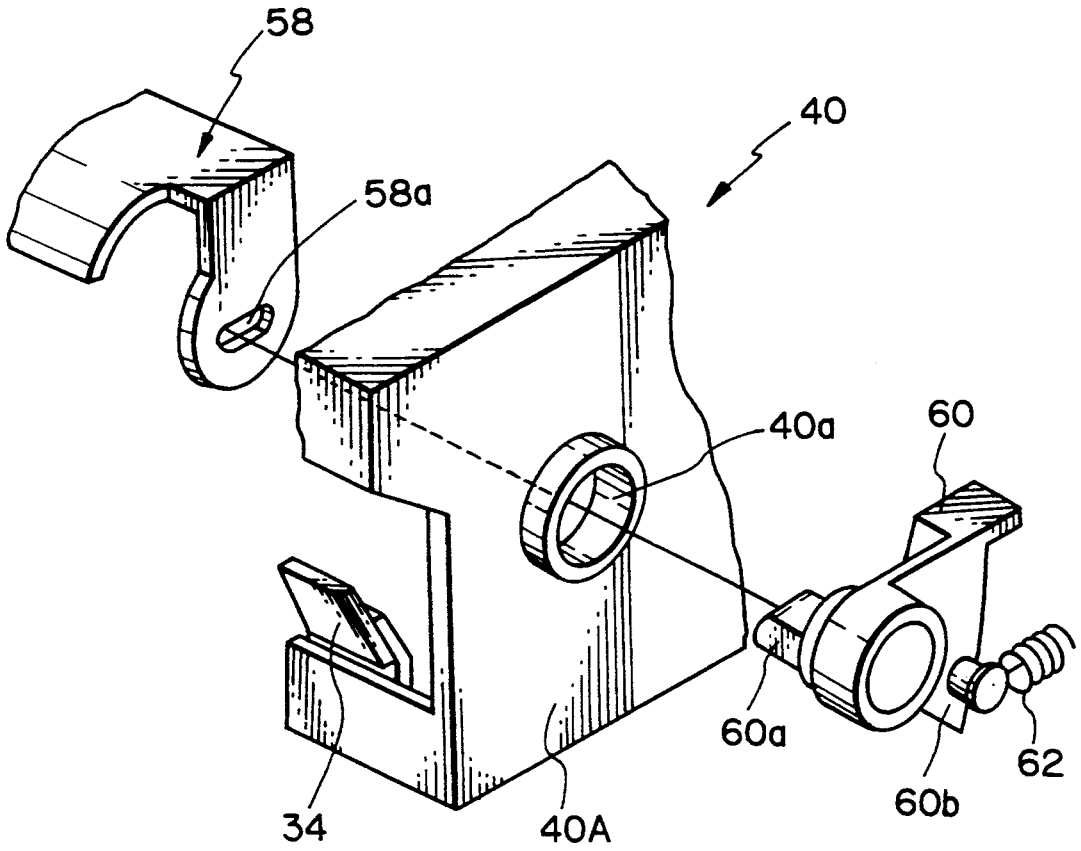
FIG. 4 is a perspective view of an electromagnet shutter included in the embodiment.
Figure 5A:
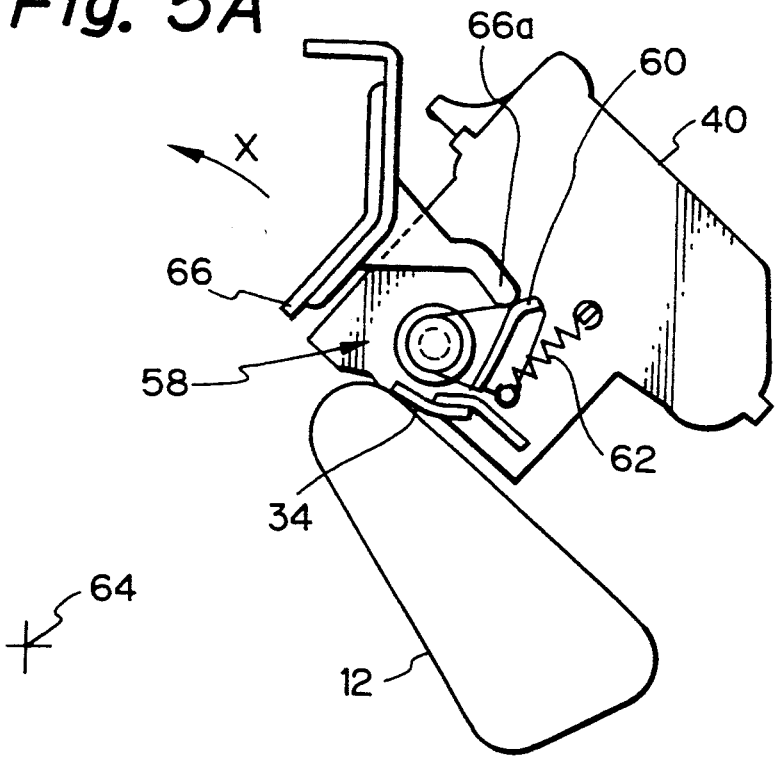
FIGS. 5A and 5B are views demonstrating the operation of the electromagnet shutter.
Figure 5B:
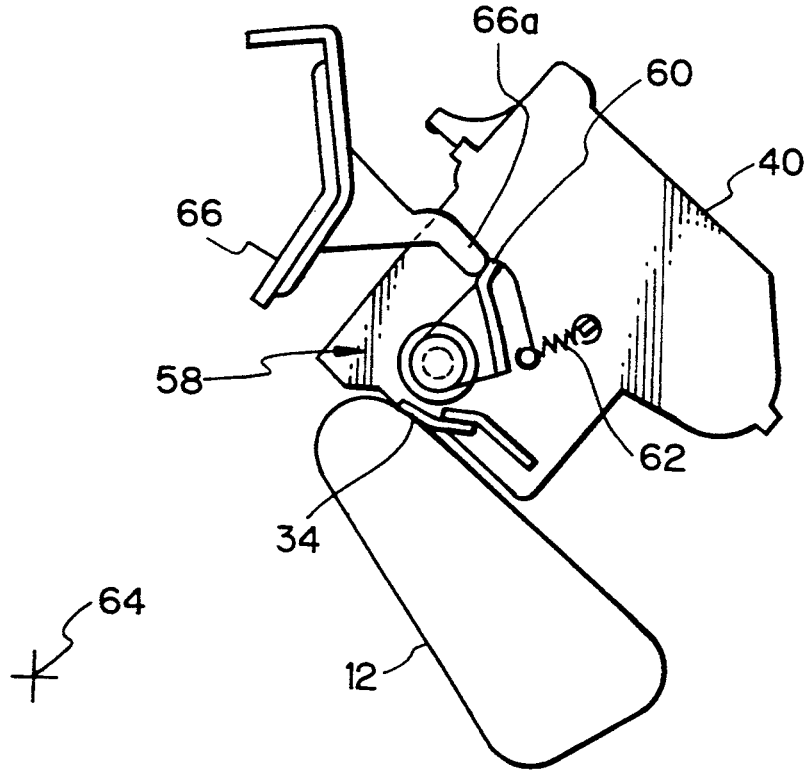
Figure 6:
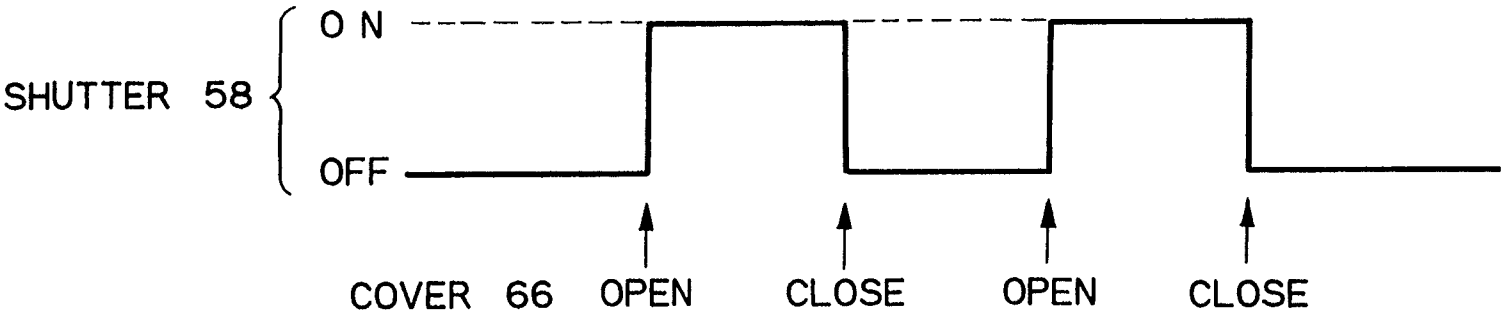
FIG. 6 is a timing chart representative of a relation between the ON/OFF states of the electromagnet shutter and the movements of a cover for driving it.

Referring to FIGS. 3A and 3B, a CTM embodying the present invention is shown. In FIGS. 3A and 3B, the same or similar constituents as or to the constituents shown in FIGS. 1, 2A and 2B are designated by like reference numerals, and a detailed description will be omitted to avoid redundancy. As shown, the CTM, generally 40, has a waste toner tank 36 accommodating a cleaning blade 34, a raking brush 52, a flicker 54, and an electromagnet shutter 58. The electromagnet shutter 58 is shown in a closed position in FIG. 3A and in an open position in FIG. 3B. As shown in FIG. 4, the shutter 58 is formed with a hole 58*a*. The CTM 40 has a casing 40A formed with a boss 40*a*. A lug 60*a* extends out from a lever 60 and mates with the hole 58*a* of the shutter 58 via the boss 40*a*. As a result, the shutter 58 and lever 60 are engaged with each other. A spring 62 is anchored at one end to a hook portion 60*b* also forming part of the lever 60 and at the other end to a hook portion, FIGS. 5A and 5B, provided on the casing 40A. As the lever 60 is rotated, it causes the shutter 58 to rotate about the hole 58*a* thereof in an opening or closing direction. Specifically, as shown in FIGS. 5A and 5B, a cover 66 is rotatable about a fulcrum 64 in a direction X in the event of replacement of the CTM 40 or the removal of a jamming sheet, as the case may be. The cover 66 has a pusher 66*a* which causes the lever 60 to rotate. FIGS. 5A and 5B correspond respectively to FIGS. 3A and 3B with respect to the positional relation between the shutter 58 and cleaning blade 34. Stated another way, when the cover 66 is rotated in the direction X, the shutter 58 opens. More specifically, as shown in FIG. 6, the shutter 58 is brought to an ON state when the cover 66 rotates or opens in the direction X or to an OFF state when it rotates or closes in the other direction.

Figure 7:
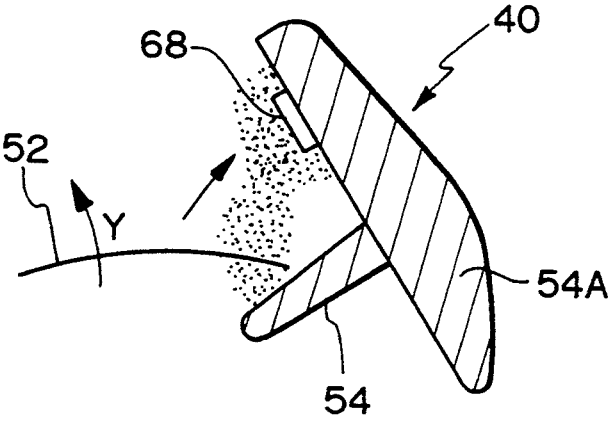
FIGS. 7, 8 and 9 are sections each showing an alternative embodiment of the present invention.

FIG. 7 shows an alternative embodiment having a sheet-like magnet 68. As shown, the magnet 68 is mounted on a support member 54A associated with the flicker 54 or on a partition which separates the toner reservoir 24 and waste toner tank 36 of the CTM 40. The magnet 68 is located at a position which the raking brush 52 will reach just after it is moved away from the flicker 54 while rotating in a direction Y. In this embodiment, the toner beaten off from the brush 52 by the flicker 54 is caught by the magnet 68 and, therefore, prevented from being scattered around in the copier.

Figure 8:
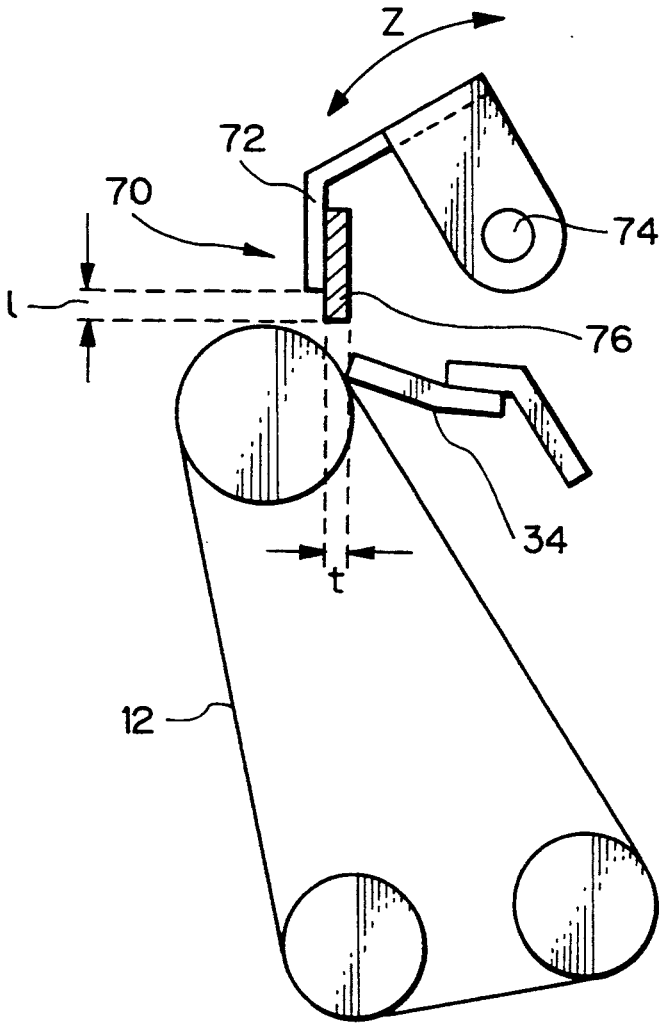

FIG. 8 shows another alternative embodiment using a magnet shutter 70 implemented with an ordinary permanent magnet in place of the electromagnet shutter. As shown, the magnet shutter 70 is made up of a shutter member 72 rotatable about a shaft 74 in a direction Z, and a permanent magnet 76 affixed to the shutter member 72 for magnetically collecting the toner which would otherwise be scattered around. Assume that the magnet 76 is constituted by a plastic magnet, rubber magnet or similar relatively inexpensive magnet. Then, if the magnet 76 has a thickness t smaller than 1 millimeter, it cannot attract a sufficient amount of toner although it may be fully magnetized. Conversely, if the thickness t is greater than 3 millimeters, it cannot attract the toner existing at the edge of the cleaning blade 34. In the embodiment, therefore, the thickness t of the magnet 76 is selected in the range of from 1 millimeter to 3 millimeters. The magnet 76 protrudes from the edge of the shutter member 72 by a distance l which ranges from 1 millimeter to 6 millimeters. Further, since the magnet 76 is magnetized in a stripe pattern at one or both ends thereof, it exerts an intense attracting force on the toner.

Figure 9:
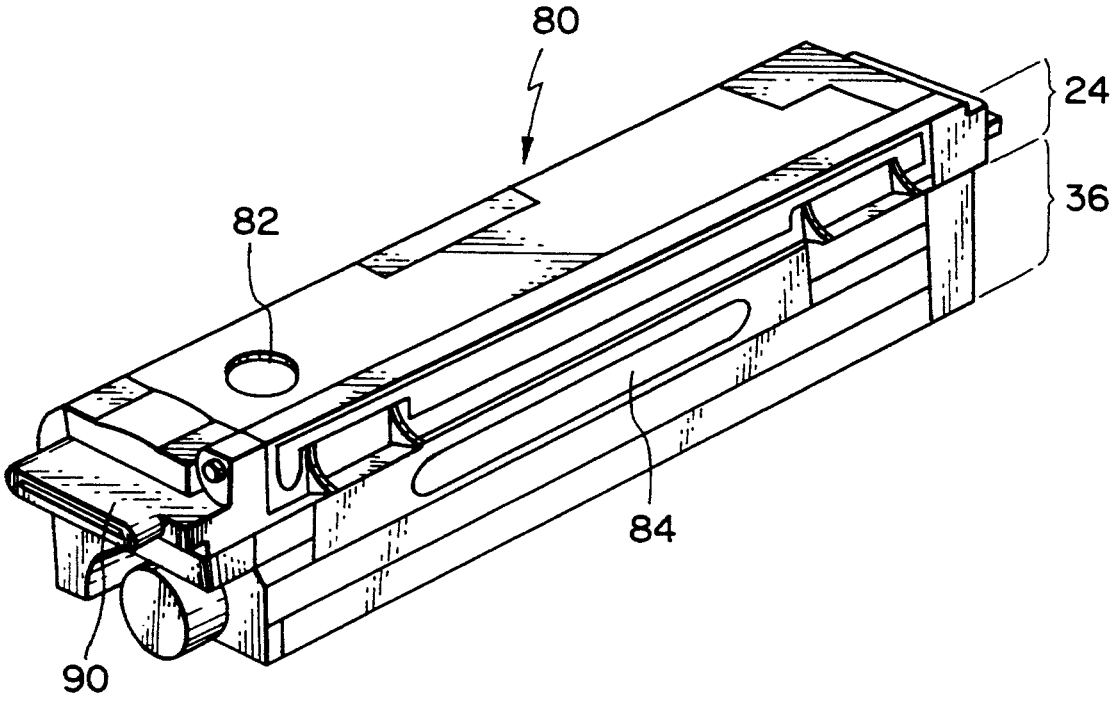
Figure 10A:
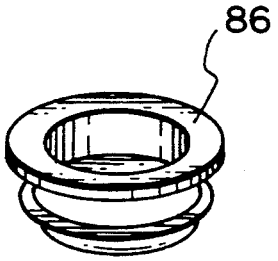
FIGS. 10A and 10B are respectively a perspective view and a section showing a cap for closing an opening formed through a toner reservoir of the CTM shown in FIG. 9.
Figure 10B:
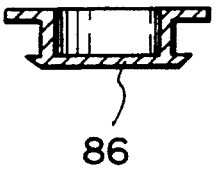
Figure 1:
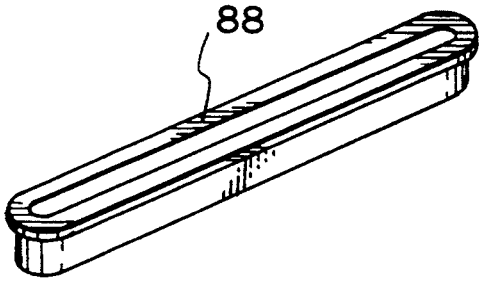

Referring to FIG. 9, another alternative embodiment of the present invention will be described. As shown, the CTM, generally 80, is constructed such that even when the waste toner tank 36 is filled up and the toner reservoir 24 is emptied substantially at the same time, the CTM 80 does not have to be replaced with a new one. Specifically, the toner reservoir 24 is formed with an opening 82 for supplementing a toner while the waste toner tank 36 is formed with an opening 84 for discharging the collected waste toner. FIGS. 10A and 10B show a specific configuration of a cap 86 for closing the opening 82. FIG. 11 shows a specific configuration of a cap 88 for closing the opening 84. Assume that the CTM 80 has the waste toner tank 36 filled up with the waste toner and the toner reservoir 24 emptied. Then, the operator removes the CTM 80 from the copier, empties the waste toner tank 36 via the opening 84 by using, for example, a vacuum cleaner, fills the toner reservoir 24 with a supplementary toner via the opening 82, and then inserts the CTM 80 into the copier. In this condition, the CTM 80 is ready to operate in exactly the same manner as a new CTM.

If desired, the supplementary toner may be filled in the reservoir 24 via a supplement opening originally formed in the CTM 80 in place of the opening 82. The supplement opening will appear when a side cover 90 provided on the CTM 80 is removed. Likewise, the waste toner may be removed via an opening included in the cleaning section in place of the opening 84 in the event when the cleaning blade 34 is replaced. Further, the caps 86 and 88 shown in FIGS. 10A and 10B and FIG. 11, respectively, may each be replaced with a seal member, if desired.

In summary, it will be seen that the present invention provides a combined CTM capable of effectively removing a waste toner heretofore unable to be collected and preventing it from being scattered around in an image forming apparatus. In addition, since the CTM can be repetitively used without being discarded, it promotes the efficient use of limited resources and protects the environment.

Various modifications will become possible for those skilled in the art after receiving the teachings of the present disclosure without departing from the scope thereof.

What is claimed is:

1. A combined cleaner and toner magazine (CTM) for an image forming apparatus, comprising:

toner supplying means for supplying a toner to a developing unit;

cleaning means constructed integrally with said toner supplying means for removing and storing the toner remaining on a photoconductive element after image transfer; and preventing means for preventing part of the toner left on the photoconductive element without being stored in said cleaning means from being scattered around in said image forming apparatus;

wherein:

said preventing means comprises an openable electromagnet shutter; and said electromagnet shutter comprises an openable shutter member, and control means for selectively opening or closing said shutter member.

2. A CTM as claimed in claim 1, wherein said cleaning means comprises:

a raking brush for collecting and storing said part of the toner; and a flicker for beating said raking brush to remove the toner deposited on said raking brush;

said preventing means comprising attracting means located in the vicinity of said flicker for attracting said part of the toner left on the photoconductive element.

3. A CTM as claimed in claim 2, wherein said attracting means comprises a sheet-like magnet.

4. A CTM as claimed in claim 1, wherein said cleaning means comprises:

a waste toner tank for storing and discarding the toner removed by said cleaning means; and an opening formed through said waste toner tank for discharging the toner filling said waste toner tank.

5. A CTM as claimed in claim 4, wherein said toner supplying means comprises a toner reservoir storing the toner to be supplied to the developing unit; and an opening formed through said toner reservoir for filling said toner reservoir with a supplementary toner when said toner reservoir is emptied.

6. A combined cleaner and toner magazine (CTM) for an image forming apparatus, comprising:

toner supplying means for supplying a toner to a developing unit;

cleaning means constructed integrally with said toner supplying means for removing said storing the toner remaining on a photoconductive element after image transfer; and preventing means for preventing part of the toner left on the photoconductive element without being stored in said cleaning means from being scattered around in said image forming apparatus;

wherein:

said preventing means comprises an openable permanent magnet shutter;

said permanent magnet shutter comprises an openable shutter member and a sheet-like permanent magnet affixed to said shutter member; and said sheet-like permanent magnet is 1 millimeter to 3 millimeters thick.

7. A combined cleaner and toner magazine (CTM) for an image forming apparatus, comprising:

toner supplying means for supplying a toner to a developing unit;

cleaning means constructed integrally with said toner supplying means for removing and storing the toner remaining on a photoconductive element after image transfer; and preventing means for preventing part of the toner left on the photoconductive element without being stored in said cleaning means from being scattered around in said image forming apparatus;

wherein:

said preventing means comprises an openable permanent magnet shutter;

said permanent magnet shutter comprises an openable shutter member and a sheet-like permanent magnet affixed to said shutter member; and said sheet-like permanent magnet protrudes 1 millimeter to 6 millimeters from an edge of said shutter member.

* * * * *